US006520755B1

(12) United States Patent
Kittock et al.

(10) Patent No.: US 6,520,755 B1
(45) Date of Patent: Feb. 18, 2003

(54) FLUID-MOVING DEVICE WITH INTEGRATED VALVE

(75) Inventors: Mark J. Kittock, Eden Prarie, MN (US); Humayun Qureshi, Eden Prarie, MN (US)

(73) Assignee: Beckman Coulter, Inc., Fullerton, CA (US)

( * ) Notice: Subject to any disclaimer, the term of this patent is extended or adjusted under 35 U.S.C. 154(b) by 0 days.

(21) Appl. No.: 09/685,474

(22) Filed: Oct. 10, 2000

(51) Int. Cl.[7] ..... F04B 39/00
(52) U.S. Cl. ..... 417/434; 137/454.5
(58) Field of Search ..... 417/437, 439, 417/442; 137/454.4, 454.5, 884, 861, 883

(56) References Cited

U.S. PATENT DOCUMENTS

| | | | | |
|---|---|---|---|---|
| 3,948,607 A | | 4/1976 | Atwood et al. | 23/259 |
| 3,951,167 A | * | 4/1976 | Howell et al. | 137/884 |
| 3,969,451 A | | 7/1976 | Floyd et al. | |
| 4,076,459 A | * | 2/1978 | Adams et al. | 417/217 |
| 4,501,120 A | | 2/1985 | Holland | |
| 4,536,140 A | | 8/1985 | Guthrie | |
| 4,715,406 A | | 12/1987 | Kress | |
| 4,830,583 A | | 5/1989 | Edson | |
| 5,118,075 A | | 6/1992 | Portolese | |
| 5,145,340 A | | 9/1992 | Allard | |
| 5,378,124 A | | 1/1995 | Welch | |
| 5,470,209 A | | 11/1995 | Hartley | |
| 5,669,764 A | | 9/1997 | Behringer et al. | |
| 5,701,797 A | | 12/1997 | Mohn | |
| 5,771,931 A | | 6/1998 | Watson | |
| 6,007,069 A | | 12/1999 | Sadowski | |
| 6,179,587 B1 | | 1/2001 | Kurth | 417/517 |

FOREIGN PATENT DOCUMENTS

| | | |
|---|---|---|
| DE | 0 024 313 A1 | 7/1980 |
| DE | 197 16 242 A1 | 4/1997 |
| EP | 0 959 005 A2 | 1/2001 |

* cited by examiner

*Primary Examiner*—Teresa Walberg
*Assistant Examiner*—Thor Campbell
(74) *Attorney, Agent, or Firm*—Hogan & Hartson LLP; William H. May; D. David Hill

(57) ABSTRACT

A fluid-moving device with an integrated valve is disclosed. The device includes a housing defining a suction chamber and at least one internal passageway formed inside the housing. A first end of the internal passageway opens to the suction chamber and a second end of the internal passageway connects to an outside surface of the housing. The fluid-moving device of the present invention also includes a pumping structure disposed inside the suction chamber for generating a pressure inside the suction chamber. The device may also include valve passageways formed inside the housing. In one embodiment, a manifold is utilized for connecting the valve passageways to fluid supplies and fluid sinks. The manifold has a casing, at least one input port, at least one output port, and a plurality of internal manifold passageways formed in the manifold casing. A method of making a fluid-moving device with an integrated valve of the present invention is also disclosed.

17 Claims, 4 Drawing Sheets

Fig. 1
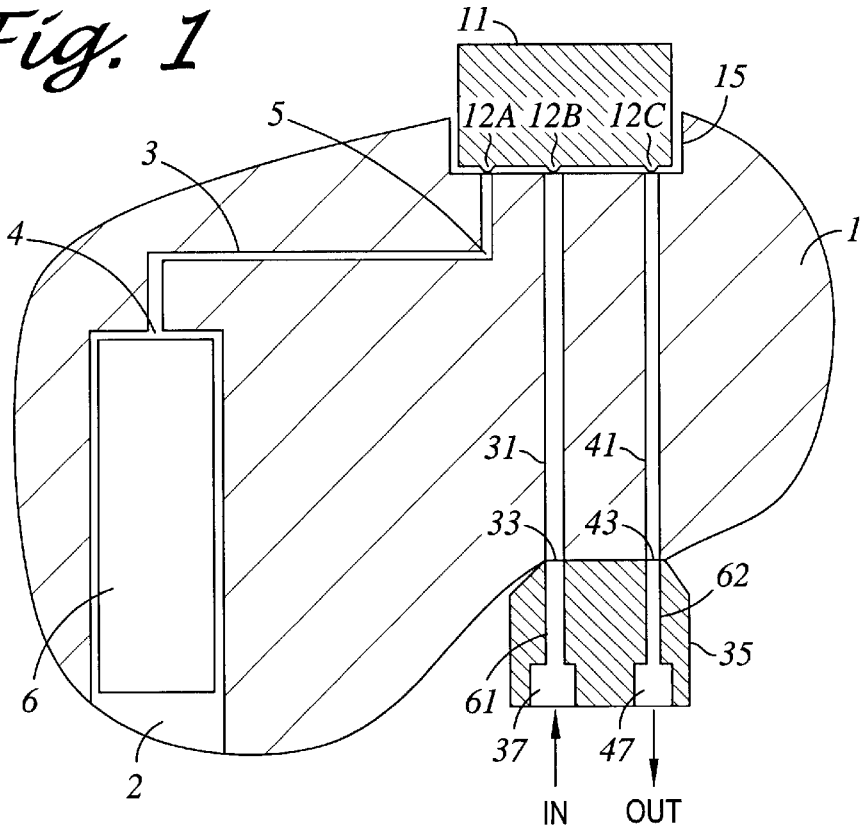
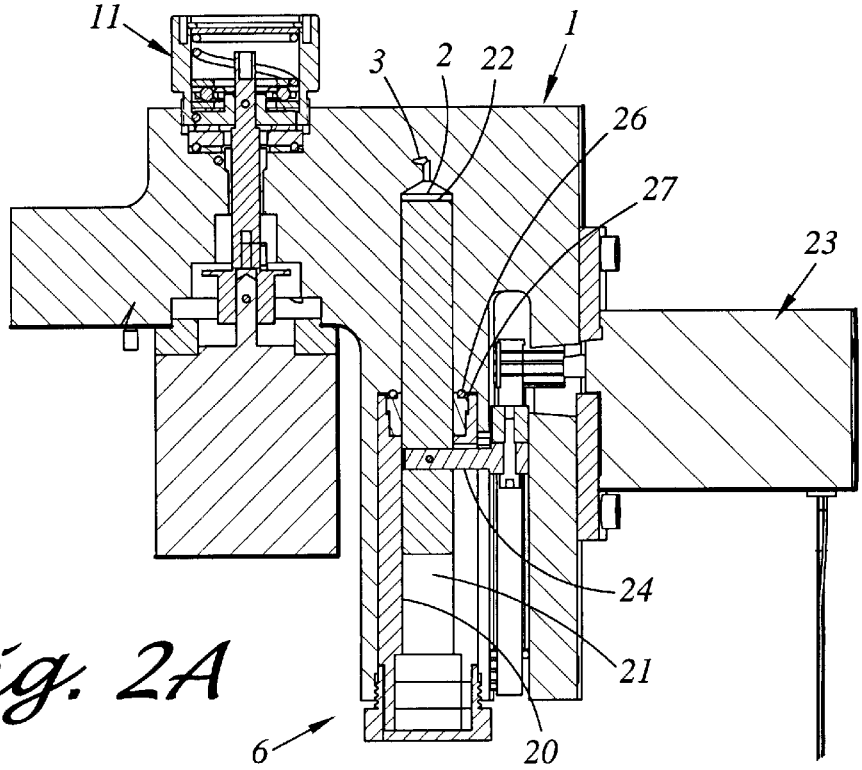
Fig. 2A

Fig. 3
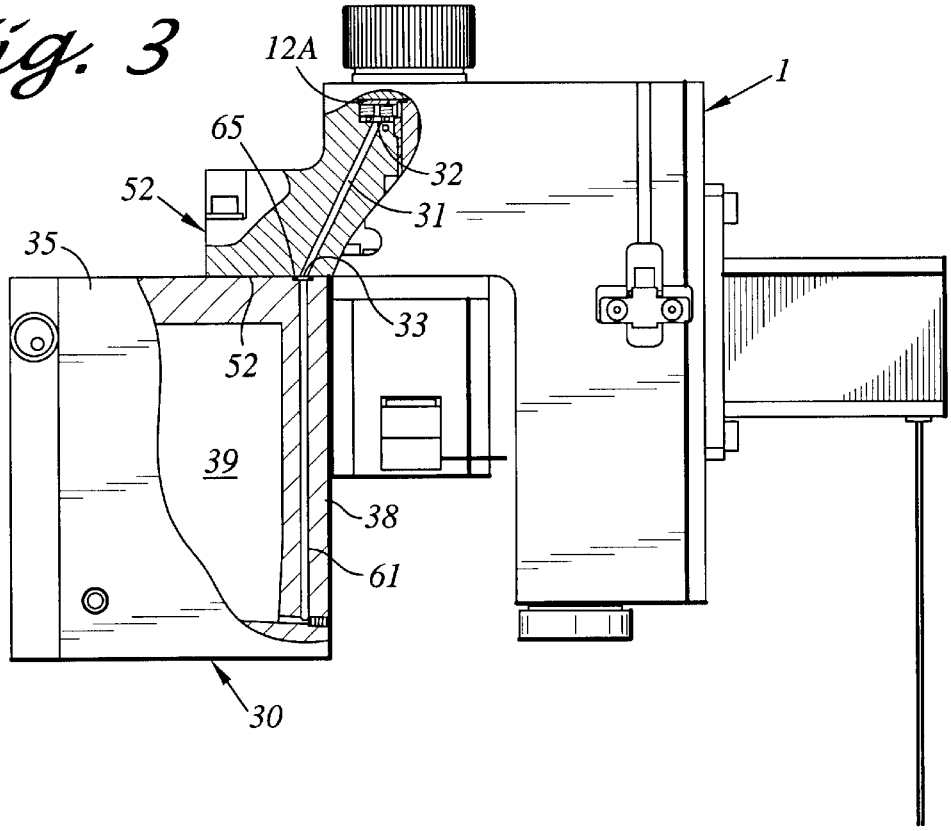
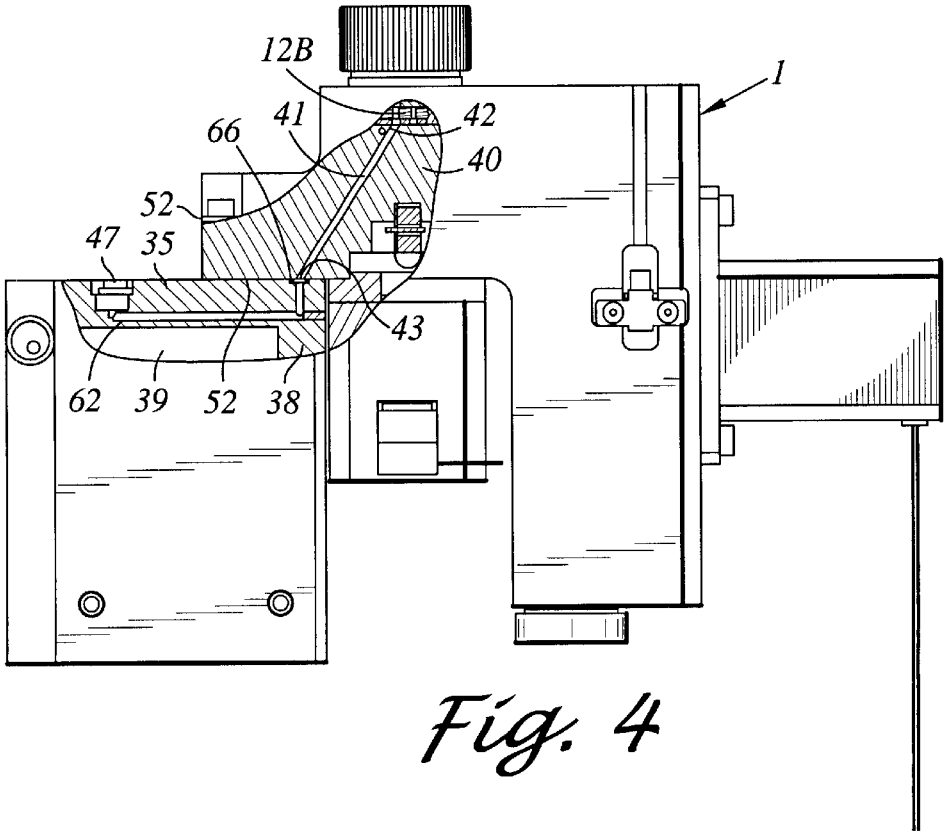
Fig. 4

FLUID-MOVING DEVICE WITH INTEGRATED VALVE

BACKGROUND OF THE INVENTION

1. Area of the Art

The invention relates generally to fluid-moving devices. More particularly, the invention is directed to fluid-moving devices, such as piston pumps, with integrated valves.

2. Description of the Related Art

In many types of fluid-moving equipment, such as liquid pumps, slurry pumps, dry mixers, dispensers and numerous other devices, the pumping action is accomplished by a sliding plunger, rod, piston, or another similar member, reciprocally moving inside a stationary bearing. Typically, a pump housing encases the bearing and the piston, while the input/output valves are set outside of the pump housing. Most commonly, connecting tubing and fittings are utilized to connect the valves to the pump. As the fluid passes through each connection, pump to fitting, fitting to tubing, etc., the fluid flow is disturbed and the accuracy and precision of the fluid-moving equipment are adversely affected. Also, depending on the selected tubing type and operating pressure, the tubing may flex and bend, thus disrupting the fluid flow even more and further affecting the dispensing accuracy of the fluid-moving equipment.

Automated analytical instruments are broadly used in chemical, biological, and clinical laboratories, often for testing small sample volumes. When dealing with small volumes or diluted samples, even a minute change in sample dispensing accuracy may lead to substantial analytical errors. When conventional pumps are utilized for sample dispensing in an analytical instrument, the tubing and the fittings between the pump and the input/output valves require frequent maintenance checks for leaks and flow obstructions in order to provide a reliable operation of the instrument. Also, the worn-out tubing and fittings have to be replaced promptly.

Therefore, the conventional fluid-moving equipment does not provide a consistent and accurate fluid dispensing, unless the connecting fittings and tubing are adjusted or replaced frequently. Consequently, the maintenance of the conventional fluid-moving equipment is laborious and costly, particularly when the equipment is used for processing large sample batches, diluted samples, or small sample volumes.

SUMMARY OF THE INVENTION

Accordingly, it is an objective of the present invention to provide a fluid-moving device which avoids the undesirable features of the prior devices. Particularly, it is an objective of the present invention to provide a convenient fluid-moving device with high dispensing accuracy, relatively low maintenance cost, and superior reliability in use.

These and other objects are achieved in a fluid-moving device of the present invention. The device includes a housing defining a suction chamber and at least one internal passageway formed inside the housing. A first end of the internal passageway opens to the suction chamber and a second end of the internal passageway connects to an outside surface of the housing. The fluid-moving device of the present invention also includes a pumping structure disposed inside the suction chamber for generating a pressure inside the suction chamber.

The fluid-moving device of the present invention may be connected to or integrated with a secondary device or structure by utilizing passageways formed in the housing instead of conventional tubing. In a preferred embodiment, the secondary device is a valve with at least one fluid communication port. The fluid communication port of the valve is connected to the second end of the internal passageway, whereby the pressure generated in the suction chamber is communicated to the valve.

The valve may be mounted on the housing. Alternatively, a valve chamber may be provided in the housing and the valve may be positioned in the valve chamber, at least partially. The fluid-moving device of the present invention may also include valve passageways formed inside the housing. The valve passageways provide a fluid communication between fluid communication ports of the valve and the outside. In one embodiment, a manifold is utilized as an intermediate element for connecting the valve passageways to fluid supplies and fluid sinks. The manifold has a casing, at least one input port, at least one output port, and a plurality of manifold passageways formed in the manifold casing. The manifold passageways connect the valve passageways to the manifold input and output ports.

In another aspect, the invention provides a method of making a fluid-moving device with an integrated valve. The method comprises:

(a) providing a solid housing having a suction chamber; and (b) forming an internal passageway, wherein a first end of the internal passageway opens to the suction chamber and a second end of the internal passageway connects to an outside surface of the housing.

By eliminating tubing and connectors between the valve and the pumping structure, the present fluid-moving device alleviates many of the problems associated with the conventional devices discussed above. The advantages of this approach include a greater precision of fluid-delivery, simplified assembly and maintenance, significantly improved reliability, and a decreased maintenance cost. The device is well-suited for use in any system that requires drawing, moving, and dispensing of fluids.

The invention may be particularly advantageous for use in conjunction with analytical instrumentation that requires precise dispensing of liquid samples. For example, a piston pump with an integrated valve manufactured in accordance with the present invention may be beneficially utilized for sample aspiration and dispensing in NexGen Access System (Beckman Instruments, CA), disclosed in a commonly assigned U.S. patent application titled "Method and System for Automated Immunochemistry Analysis", concurrently filed with the present application, which is incorporated by reference herein in its entirety.

The invention is defined in its fullest scope in the appended claims and is described below in its preferred embodiments.

DESCRIPTION OF THE FIGURES

The above-mentioned and other features of this invention and the manner of obtaining them will become more apparent, and will be best understood by reference to the following description, taken in conjunction with the accompanying drawings, in which:

FIG. 1 is a schematic representation of a fluid-moving device, according to one embodiment of the present invention.

FIG. 2A is side sectional view of a piston pump with an integrated valve and a manifold, according to one embodiment of the present invention.

FIG. 3 is a side view of the piston pump with an integrated valve and a manifold shown in FIG. 1 with a partial side section depicting the valve and the manifold passageways connecting a valve inlet with a fluid input port on the manifold, in accordance with one embodiment of the present invention.

FIG. 4 is a side view of the piston pump with an integrated valve and a manifold shown in FIG. 1 with a partial side section depicting the valve and the manifold passageways connecting a valve outlet with a fluid output port on the manifold, in accordance with one embodiment of the present invention.

DETAILED DESCRIPTION OF THE PREFERRED EMBODIMENTS

Figure 2B:
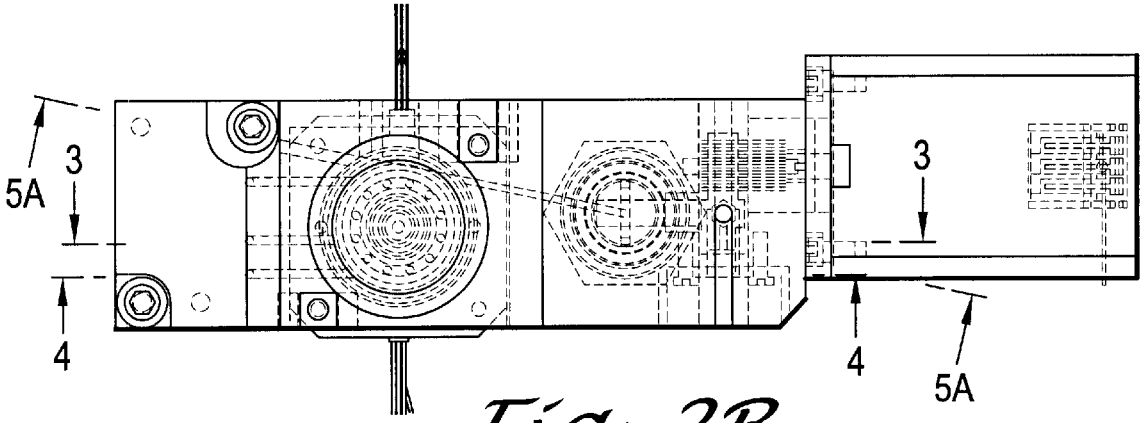
FIG. 2B is a top view of a piston pump with integrated valve and a manifold according to one embodiment of the present invention. The view shows a placement of a section line 5B—5B to obtain FIG. 5B.
Figure 2C:
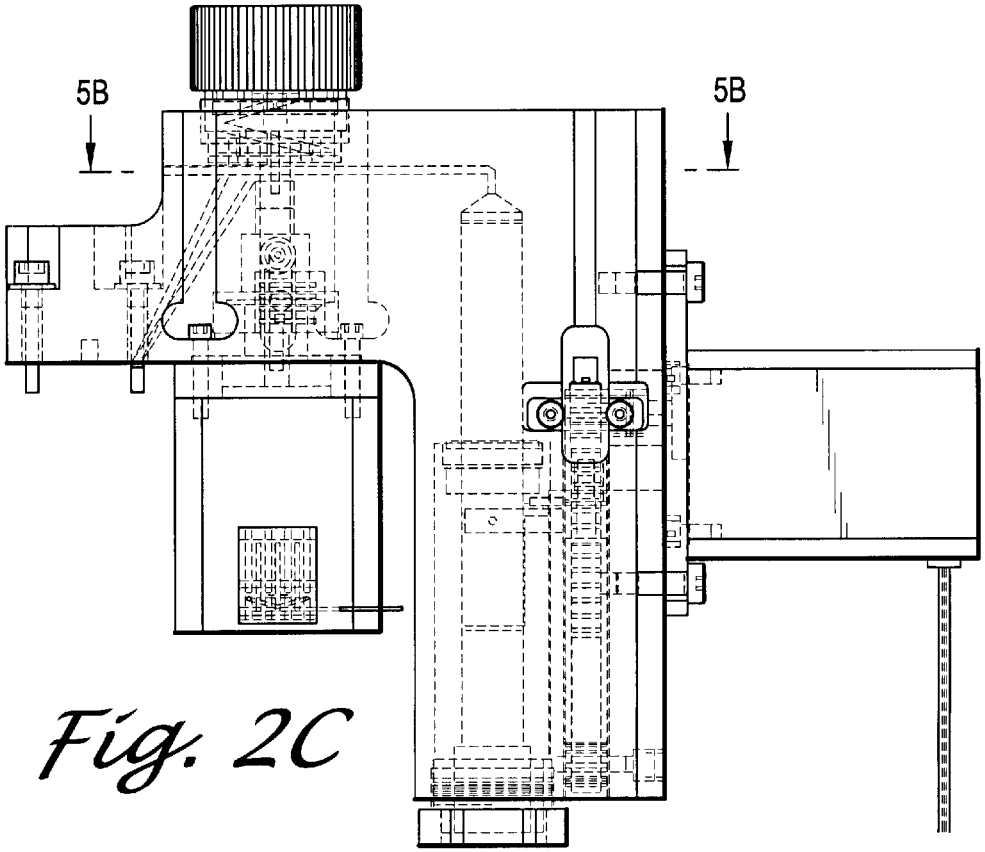
FIG. 2C is a side view of a piston pump with an integrated valve of FIG. 2B. The view shows a placement of section lines 3—3; 4—4; and 5A—5A to obtain FIGS. 3, 4, and 5A, respectively.

The present invention provides a fluid-moving device with an internal pumping structure that can be connected to or integrated with secondary structures or devices without the use of external tubing. By utilizing passageways formed in the housing of the fluid-moving device for connecting the pumping structure and the secondary structures and devices, this invention eliminates a need for conventional external tubing.

The fluid-moving device of this invention may be a liquid pump, slurry pump, dispensing pump, dry mixer, dispensers, or any other device, in which the pumping action is accomplished by a sliding plunger, rod, piston, or another similar member, reciprocally moving inside a stationary bearing. In a preferred embodiment of the present invention, the secondary structure is a valve. Any type of valve and/or a plurality of valves may be integrated with the fluid-moving device of the present invention. Examples of valves that may be integrated include, but are not limited to, face shear valves, diaphragm valves, and cup type shear valves.

While this invention may be used in an association with many of the abovementioned fluid-moving devices, and while a particular configuration of the invention may take on different or modified forms, a piston pump with an integrated face shear valve depicted in FIGS. 1–5 will be used to illustrate the invention in more detail.

Referring to FIG. 1 which provides a schematic representation of one embodiment of the present invention, a fluid-moving device of the instant invention includes a housing 1 defining a suction chamber 2 and an internal passageway 3 formed inside the housing. The internal passageway has a first end 4 opening to the suction chamber 3 and a second end 5 connecting to an outside surface of the housing, e.g., to a fluid communication port 12A of valve 11. The instant fluid- moving device further includes a pumping structure 6 disposed inside the suction chamber to generate a pressure therein. For the purpose of this invention, connecting or providing a fluid communication between two parts means connecting them in such a way that a fluid-tight seal is formed and substantially no fluid flow obstruction is created. The internal passageway may be directly connected to the outside surface of the housing by extending the second end 5 through the housing. Alternatively, the internal passageway may be connected to the outside indirectly, by utilizing additional passageways 7 as will be described later.

Referring to FIG. 2A, the pumping structure 6 may comprise a bearing 20 disposed in a suction chamber 2. The bearing has an elongated aperture 21. A moving member, such as a piston 22, is disposed coaxially and slidably inside the aperture 21.

The operation of the fluid-moving device of the present invention doesn't differ from the operation of conventional fluid-moving devices. The piston 22 is driven by a motor 23 through a piston shaft 24. A reciprocal movement of the piston 22 produces the suction of a fluid from an inlet circuit 30, shown in FIG. 3, and delivery of the fluid to a delivery circuit 40, shown in FIG. 4. The inlet and delivery circuits are discussed in detail below. Referring to FIG. 2A, the pump piston 22 is sealed by sealing elements 26 and 27. The type of the piston seal used is not crucial to this invention as long as it allows a required pumping force in the system. In one embodiment shown in FIG. 2A, a ceramic clearance seal described in a commonly assigned and concurrently filed U.S. patent application titled "Fluid-Moving Device with a Clearance Seal" is used.

The housing 1 of the present invention may be made of any solid material. Preferably, the housing is made from a rigid material that does not visibly deform during operation, thus further improving accuracy and precision of the instant fluid-moving device. Examples of such rigid materials include metal, and certain plastics. The suction chamber and the suction passageway may be machined, for example drilled, in the housing. Alternatively, the housing may be made of two mating parts. Each part has a suction cavity and an internal groove formed between the suction cavity and the outside surface of the housing. The cavity and the groove on one mating part cooperate with the matching cavity and groove on the second mating part to form the suction chamber and the internal passageway. The grooves and cavities may be molded or machined. The methods and means of assembling two cooperating structures are well-known in the art.

Figure 5A:
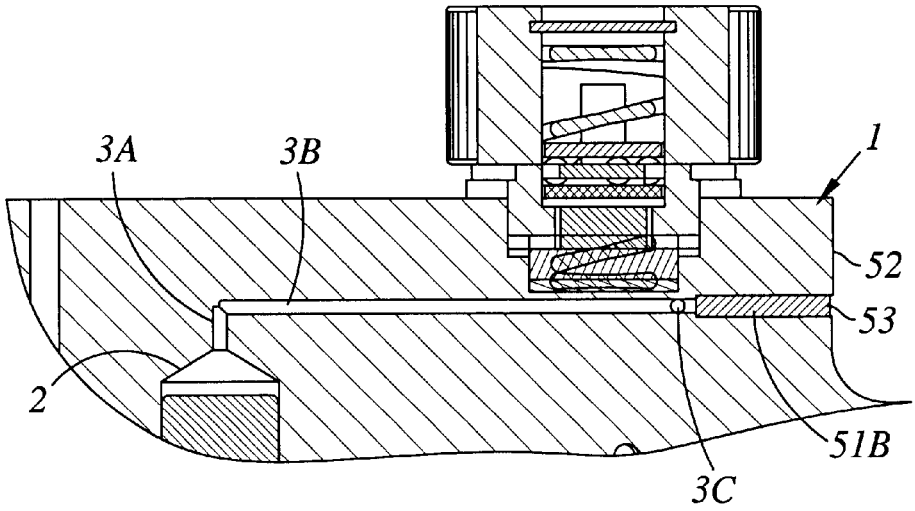
FIGS. 5A and 5B are partial side sectional (5A) and cross-sectional (5B) views of the piston pump of FIG. 1 showing an internal passageway formed inside the housing, according to the present invention.
Figure 5B:
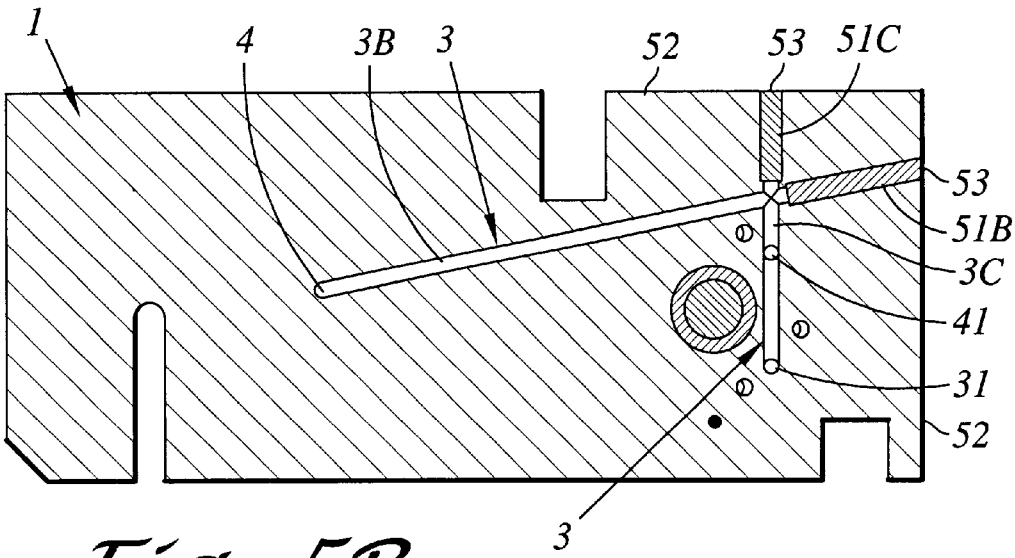

Referring to FIGS. 1, 5A, and 5B, in one embodiment, the suction passageway 3 is formed by intersecting bores, for example, 3A, 3B, and 3C in the housing 1. Referring to FIGS. 5A and 5B, outer portions 51A (not shown), and 51B and 51C of the bores, opening to the outside surface 52 of the housing, are plugged with plugs 53. The bores may be machined, for example, drilled, molded or produced by any other method, as long as the obtained bores are sufficiently smooth to have a minimal effect on the fluid flow. The plugs 53 may be made of any material providing a fluid-and air-tight blocking of the outer portions of the bores.

Referring to FIG. 1, in a preferred embodiment, the fluid-moving device further comprises a valve 11 mounted on the housing 1. The valve has at least one fluid communication port 12A connected to the second end 5 of the internal passageway 3, whereby the pressure generated in the suction chamber is communicated to the valve 11. In the most preferred embodiment, a valve chamber 15 is formed in the housing 1. The valve chamber 15 accommodates, at least partially, the valve 11.

The fluid-moving device of the present invention may have an integrated valve with a plurality of fluid communication ports 12, each port connected to the internal passageway 3. Preferably, as shown in FIG. 1, at least one communication port 12B is a fluid inlet, and at least one communication port 12C is a fluid outlet.

Referring to FIGS. 3 and 4, preferably, the fluid-moving device of the present invention further comprises a fluid inlet circuit 30 and a fluid delivery circuit 40 formed inside the housing 1. The fluid inlet circuit 30 comprises a valve passageway 31 connecting the valve inlet 12B to the outside surface 52 of the housing 1. The fluid delivery circuit 40 comprises a valve passageway 41 connecting the valve outlet 12C to the outside surface 52 of the housing 1. Each valve passageway has a first end 32 or 42 connected to the inlet 12B or the outlet 12C, respectively, and a second end 33 or 43 opened to the outside. The valve passageways 31 and 41 may be machined, for example drilled, in the housing. Alternatively, the housing may be made of two mating parts, as described above, with molded or machined matching grooves cooperating to form valve passageways.

The fluid-moving device of the present invention may be connected to fluid supplies and sinks utilizing any appropriate interface. Preferably, the interface should create a minimal effect on the fluid flow. Referring to FIGS. 1, 3, and 4, in the most preferred embodiment, a manifold 35 is used as an interface, which provides a reliable and low fluid-flow-obstructing connection to fluid sources and sinks. The manifold 35 connects the second outer ends 33 and 43 of the valve passageways 31 and 41 with a fluid cavity 39 and output ports 47, respectively.

Referring to FIGS. 1, 3 and 4, the manifold comprises a casing 38 and an internal fluid cavity 39, which serves as a fluid supply reservoir. The manifold has at least one manifold input port 37 and at least one output port 47. The manifold ports are disposed within the casing 38 and exposed to the outside. The manifold 35 further comprises a plurality of internal manifold passageways 61 and 62 formed in the manifold casing 38. The manifold passageway 61 connects the outer end 33 of the valve passageway 31 with the manifold input port 37. The manifold passageway 62 connects the outer end 43 of the valve passageway 41 with the manifold output port 47.

In some embodiments requiring more than one fluid source and more than one fluid sink and having a valve with a plurality of inlets and outlets, separate manifold and valve passageways may be formed to accommodate each fluid source and sink.

One or more housings may be attached to manifold by any appropriate method, as long as it provides a secure and fluid-tight assembly. Examples of attachment methods include, but are not limited to, securing with fasteners such as nuts and bolts or screws, clamps, and latches. These and other methods and means of assembling two structures are well-known in the art and, therefore, are not illustrated in the accompanying figures.

The connection between the valve and the manifold passageways is preferably fluid-tight. It would be appreciated by those skilled in the art that any sealing method between the valve and the manifold passageways may be used as long as it provides a reliable seal. For example, in one embodiment, an elastomeric seal, such as an o-ring 65, is positioned between the valve and the manifold passageways of the inlet circuit 30 and an elastomeric seal, such as an o-ring 66, is positioned between the valve and the manifold passageways of the delivery circuit 40.

The disclosed fluid-moving device may be used for pumping and dispensing any suitable fluid, including biological fluid samples, such as buffer solutions, reagents, patient samples.

It is to be understood that the form of the device depicted in FIGS. 1–5 has been chosen only for the purpose of describing a particular embodiment and function of the invention, and that the material of the invention can be addressed in various ways and incorporated in any other fluid-moving device with a pumping structure generating pressure inside suction chamber. Any type of valve or other secondary structure may be integrated in accordance with the present invention, which will be evident to those skilled in the art.

Another aspect of this invention is directed to a method of making a fluid-moving device with an integrated valve. The method comprises:

(a) providing a solid housing having a suction chamber; and (b) forming an internal passageway, wherein a first end of the internal passageway opens to the suction chamber and a second end of the internal passageway connects to an outside surface of the housing.

Referring to FIGS. 5A and 5B, the step of forming an internal passageway inside the housing may be accomplished by making intersecting bores, for example 3A, 3B, and 3C, in the housing. Then, outer portions 51A, 51B, and 51C of the bores, which are adjacent to the outside surface 52 of the housing, are plugged with plugs 53.

The present invention may be embodied in other specific forms without departing from its essential characteristics. The described embodiments are to be considered in all respects only as illustrative and not as restrictive. The scope of the invention is, therefore, indicated by the appended claims rather than by the foregoing description. All changes which come within the meaning and range of the equivalence of the claims are to be embraced within their scope.

What is claimed is:

1. A fluid-moving device comprising:

a housing defining a suction chamber and at least one internal passageway formed inside the housing, the internal passageway having a first end opening to the suction chamber and a second end connecting to an outside surface of the housing, wherein the housing is made of two mating parts, each part having a suction cavity and an internal groove formed between the suction cavity and an outside surface of the housing, wherein the cavity and the groove on one mating part cooperate with the matching cavity and groove on the second mating part to form the suction chamber and the internal passageway; and a pumping structure disposed inside the suction chamber for generating a pressure inside the suction chamber.

2. The fluid-moving device of claim 1, wherein the pumping structure further comprises:

a bearing disposed inside the suction chamber, the bearing having an aperture, and a moving member disposed coaxially and slidably inside the aperture, whereby a reciprocal movement of the moving member generates the pressure inside the suction chamber.

3. The fluid-moving device of claim 1, wherein the internal passageway is formed by intersecting bores, each bore having an outer portion opening to the outside surface of the housing, wherein the outer portion of each bore is plugged.

4. The fluid-moving device of claim 1, further comprising a valve mounted on the housing, the valve having at least one fluid communication port connected to the second end of the internal passageway, whereby the pressure generated in the suction chamber is communicated to the valve.

5. The fluid-moving device of claim 4, further comprising a valve chamber formed in the housing, wherein the valve is at least partially situated inside the valve chamber.

6. The fluid-moving device of claim 5, wherein the valve comprises a plurality of the fluid communication ports, each port connected to the internal passageway.

7. The fluid-moving device of claim 6, wherein at least one fluid communication port is a fluid inlet and at least one communication port is a fluid outlet.

8. The fluid-moving device of claim 7 further comprising a plurality of valve passageways formed inside the housing, wherein each passageway intersects the internal passageway and has a first end connected to the inlet or the outlet of the valve, whereby connecting the inlet and the outlet to the internal passageway, and a second end opened to the outside.

9. The fluid-moving device of claim 8, further comprising a manifold attached to the housing, wherein the manifold comprises:

a casing;

at least one input port for connecting to a fluid supply;

at least one output port for connecting to a fluid sink; and a plurality of manifold passageways formed in the casing and connecting the second ends of the valve passageways to the input or the output ports of the manifold.

10. The fluid-moving device of claim 9, further comprising an elastomeric seal positioned between the valve and the manifold passageways.

11. The fluid-moving device of claim 4, wherein a type of the valve is selected from the group consisting of: face shear valves, diaphragm valves, and cup type shear valves.

12. The fluid-moving device of claim 1, wherein the housing is made of a rigid material.

13. The fluid-moving device of claim 12, wherein the rigid material is selected from the group consisting of: metals and plastics.

14. A pump with a integrated valve comprising:

a housing having a suction chamber;

a valve attached to the housing a pumping structure disposed inside the suction chamber and creating a pressure inside the suction chamber; and an internal passageway formed inside the housing for communicating the pressure from the suction chamber to the valve, wherein the housing is made of two mating parts, each part having a suction cavity and an internal groove formed between the suction cavity and an outside surface of the housing, wherein the cavity and groove on the one mating part cooperate with the matching cavity and groove on the second mating part to form the suction chamber and the internal passageway.

15. The pump of claim 15, wherein the pumping structure comprises a bearing disposed inside the suction chamber, the bearing defining an aperture, and a moving member disposed movably inside the aperture, whereby a reciprocal movement of the moving member generates the pressure inside the suction chamber.

16. The pump of claim 14, wherein the valve has at least one fluid inlet and at least one fluid outlet, the pump further comprising valve passageways formed inside the housing, wherein each valve passageway has a first end connected to the inlet or the outlet and a second end opened to the outside.

17. The pump of claim 14, wherein the valve is a face shear valve.

* * * * *